US005188221A

United States Patent [19]

Bertrand

[11] Patent Number: 5,188,221

[45] Date of Patent: Feb. 23, 1993

[54] DISPLAY PACKAGING WITH RETRACTABLE HOOK

[75] Inventor: Victor J. Bertrand, Ile Bizard, Canada

[73] Assignee: The Ritvik Group Inc., Québec, Canada

[21] Appl. No.: 851,519

[22] Filed: Mar. 16, 1992

[51] Int. Cl.[5] ..... B65D 5/42; A63H 33/08

[52] U.S. Cl. ..... 206/44 R; 206/806; 446/128; D21/108

[58] Field of Search ..... D21/108; D6/432; 446/85, 128; 206/806, 44 R

[56] References Cited

U.S. PATENT DOCUMENTS

| | | | |
|---|---|---|---|
| D. 309,332 | 7/1990 | Olsen | D21/108 |
| D. 325,477 | 4/1992 | Poulsen et al. | D21/108 |
| D. 327,185 | 6/1992 | Ryaa | D21/108 |
| 3,082,902 | 3/1963 | Kimbrough, Jr. | 206/806 X |
| 3,302,917 | 2/1967 | Winkler | 206/806 X |
| 4,011,946 | 3/1977 | Savage et al. | 206/44 R |
| 4,349,102 | 9/1982 | Strongwater | 206/806 X |

FOREIGN PATENT DOCUMENTS

| | | | |
|---|---|---|---|
| 524753 | 4/1955 | Italy | 446/128 |

*Primary Examiner*—William I. Price
*Attorney, Agent, or Firm*—Robic

[57] ABSTRACT

A display packaging made of plastic material, having a flat hanging hook that is slidably mounted onto one of its walls, preferably the bottom wall in such a manner as to be extendable whenever desired, and retractable inside the packaging when it is not needed. When it is used to sell small construction toy blocks, the packaging may comprise on some of its walls, a plurality of coupling studs sized to match those of the blocks, thereby making it possible for the packaging itself to be part of the construction game whenever desired.

8 Claims, 3 Drawing Sheets

DISPLAY PACKAGING WITH RETRACTABLE HOOK

BACKGROUND OF THE INVENTION

1. Field of the Invention

The present invention is concerned with a plurality packaging for use to package and store, display and sell and subsequently put away any kind of wares.

The invention is also concerned with the use of such a display packaging for the marketing of a very specific kind of wares, namely small construction toy blocks like those presently being sold by the Applicant under the trade name MEGA MICRO BLOKS, and by other companies such as INTERLEGO A.G. under their own trade marks.

2. Brief Description of the Prior Art

Display packagings provided with a hook integrally projecting from one of their edges to make them hangable to a supporting rod or nail projecting from a vertical wall or panel, have been known for years and still are commonly used to retail a great number of wares, especially hardwares.

Most of these display packagings are made of cardboard and/or plastic material, and are usually not designed to be reusable after they have been opened, in order for example to put away the wares that have not been used.

All the display packagings known to the Applicant also have a hook that forms an integral part of their structure and thus cannot be removed or retracted in any way.

In the very specific field of toy business, and more particularly the retail of construction toy games, it is also of common practise to sell construction toy blocks or bricks in small packagings made of cardboard. Such packagings are usually in the form of parallelepipedic boxes that can be reused after they have been sold, for putting away the blocks or bricks they originally contained. Such packagings however are not "hookable" for display purpose and not designed in any way to be part of the construction toy game as such.

SUMMARY OF THE INVENTION

A first object of the present invention is to provide a display packaging which is so designed as to be reusable after it has opened to put away the wares it orginally contained.

Another object of the invention is to provide a display packaging of the above mentioned type, having a hanging hook that is slidably mounted in such a manner as to be extendable whenever desired, and retractable inside the packaging when it is not needed.

A further object of the invention is to provide a display packaging of the above mentioned type, especially designed for use to sell small construction toy blocks, which has onto some of its walls a plurality of coupling studs sized to match those of the blocks, thereby making it possible for the packaging itself to be part of the construction game whenever desired.

In accordance with the invention as broadly claimed hereinafter, these objects are achieved with a display packaging comprising in combination:

a box-shaped container made of a rigid material, preferably of plastic material, which container has an opening to give access thereto and at least two flat walls perpendicular to each other;

a cover detachably fixable to the container to close the opening;

a flat hook slidably mounted inside the container onto one of said the flat walls near the other one of the two flat walls;

guiding means integral to the one flat wall for holding the hook flat onto the one flat wall while allowing the hook to be slid in a direction perpendicular to the other flat wall between a retracted position where the hook is located within the container and an extended position where the flat hook extends outwardly of the container through a slot provided for this purpose in the other flat wall, and retaining means to prevent the hook from sliding out of the guiding means in both of the retracted and extended positions, these retaining means being strong enough to allow the display packaging and its content to be hung by means of the hook to a supporting structure whenever desired.

When this display packaging is intended to be used to package connectable construction toy blocks, it preferably has its cover and bottom walls externally provided with coupling means such as cylindrical studs, on which the construction toy blocks may be connected. This makes the packaging useful as a base for the blocks, and thus useful as part of a construction toy assembly.

The invention will be better understood upon reading of the following non-restrictive description of a preferred embodiment thereof, made with reference to the appended drawings.

DESCRIPTION OF A PREFERRED EMBODIMENT

Figure 1:
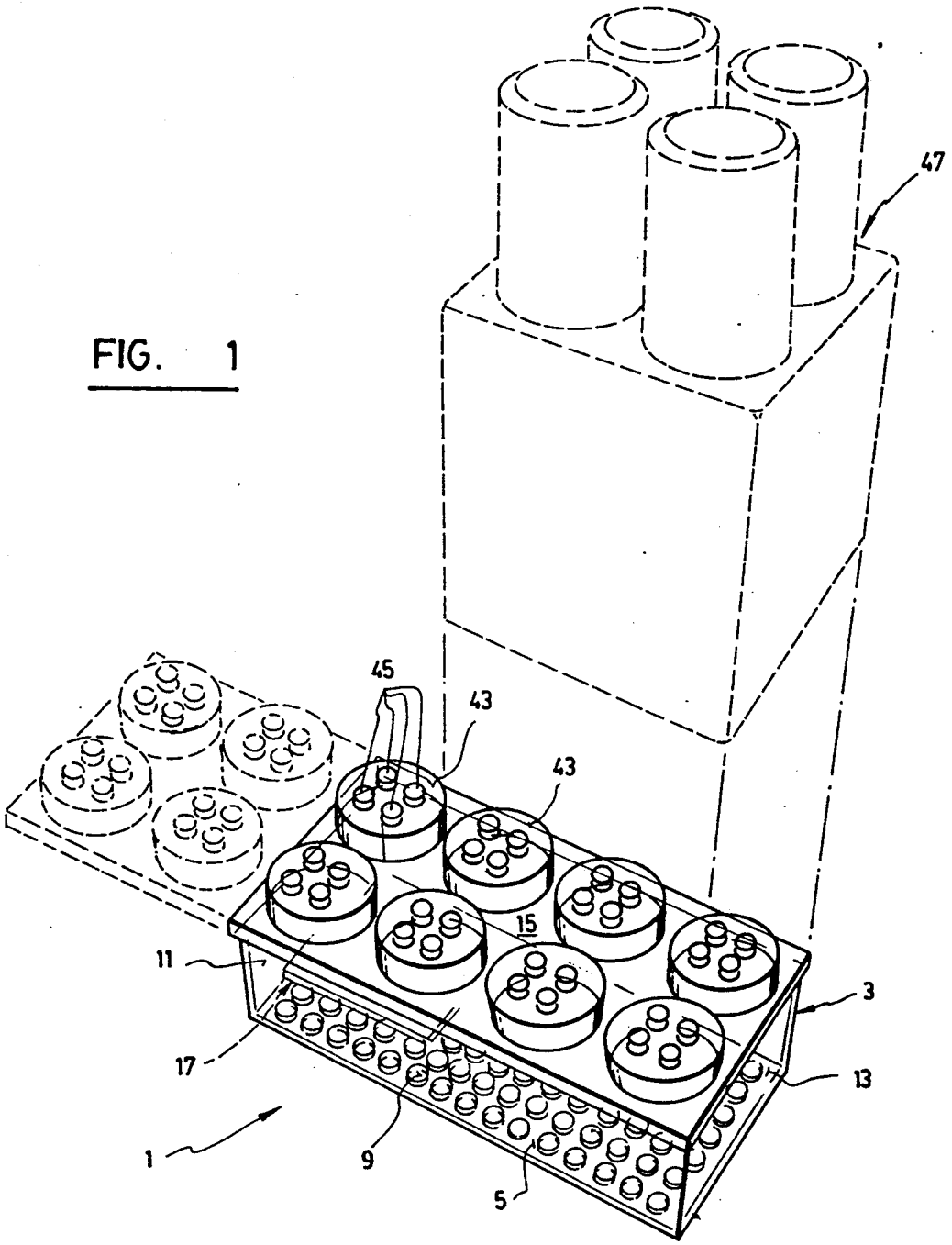
FIG. 1 is a top perspective view of a display packaging according to the invention, provided with a slidable cover having large coupling studs for use to connect large construction toy blocks.

The display packaging 1 according to the invention as shown in the accompanying drawings, comprises a box-shaped container 3 that is made of rigid, transparent plastic material.

This container 3 is parallelepipedic in shape and includes a bottom wall 5, two long side walls 7, 9 and two small sides walls 11, 13. The side walls define together an opening that gives access to the container.

A cover 15 is detachably fixed to the containers to close the opening. This cover 15 is flat and mounted with tongues and grooves onto the top edges of the long side walls 7, 9 of the container in such a manner as to be slidable in a plane extending parallel to the bottom wall 5, as is shown in FIG. 1.

In accordance with the invention, a flat hook 17 is slidably mounted inside the container onto its bottom wall 5 near the middle of one of the side walls perpendicular thereto, say the small side wall 11.

Figure 3:
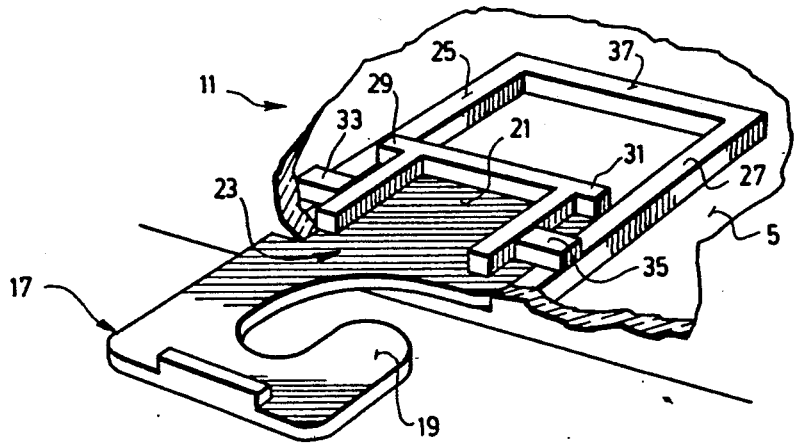
FIG. 3 is an enlarged perspective views of the retractable hook of the display packaging shown in FIGS. 1 and 2.

As better shown in FIG. 3, this hook 17 has a hook-shaped front end 19 and a rear end 21 of constant width.

Figure 4:
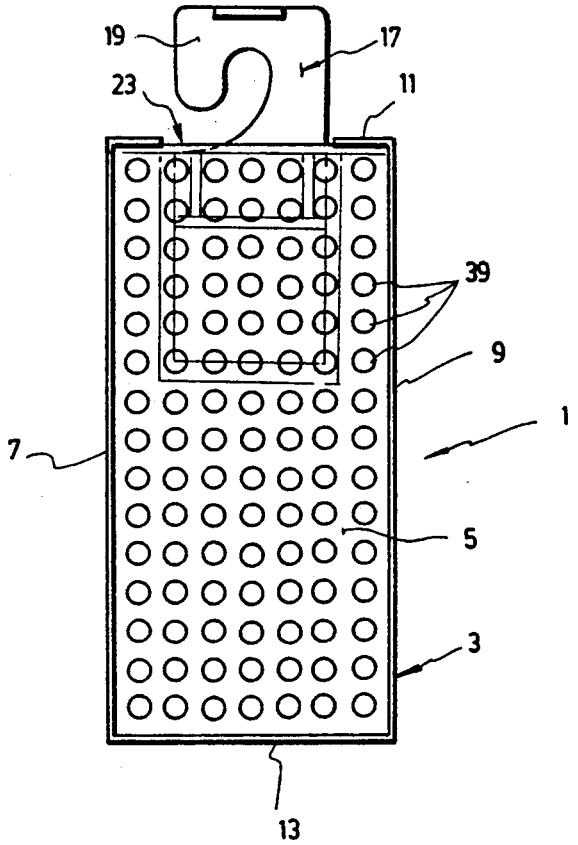
FIG. 4 is a bottom plan view of the display packaging shown in FIGS. 1 and 2, with its hook in extended position.

Guiding means are provided on the bottom wall 5 for holding the hook 17 flat onto the bottom wall 5 while allowing this hook to be slid in a direction perpendicular to the side wall 11 between a retracted position and an extended position where the hook 17 extends outwardly of the container through a slot 23 provided for this purpose in the side wall 11, as shown in FIG. 4.

As better shown in FIG. 3, these guiding means preferably comprise a pair of parallel rails 25, 27 integrally projecting from the bottom wall. These rails define together with the bottom wall 5, a trough that is of the same width as the hook 17 and is in alignment with the slot 23.

Retaining means are also provided to prevent the flat hook 17 from sliding out of the trough defined by the rails 25, 27, in both of its retracted and extended positions. These retaining means which must be strong enough to allow the packaging 1 and its content to be hung by means of the hook for display purpose as shown in FIG. 4, preferably comprise a pair of locking tabs 29, 31 that integrally projects from the rear end 21 of the hook and are sized and positioned to abutt against other tabs 33, 35 that are integral to the bottom wall 5, to the rails 25, 27 or alternatively to the side wall 11 provided with the slot 23, in order to prevent the hook from sliding out of the container 1 through the slot when this hook is in extended position and its hook-shaped front end 19 projects out of the container through the slot 23. The retaining means also comprises a locking bar 37 extending between the ends of the rails 25, 27 opposite the slot 23, to close the trough defined by these rails and thus to prevent the hook 17 from sliding out of this trough in retracted position.

Figure 2:
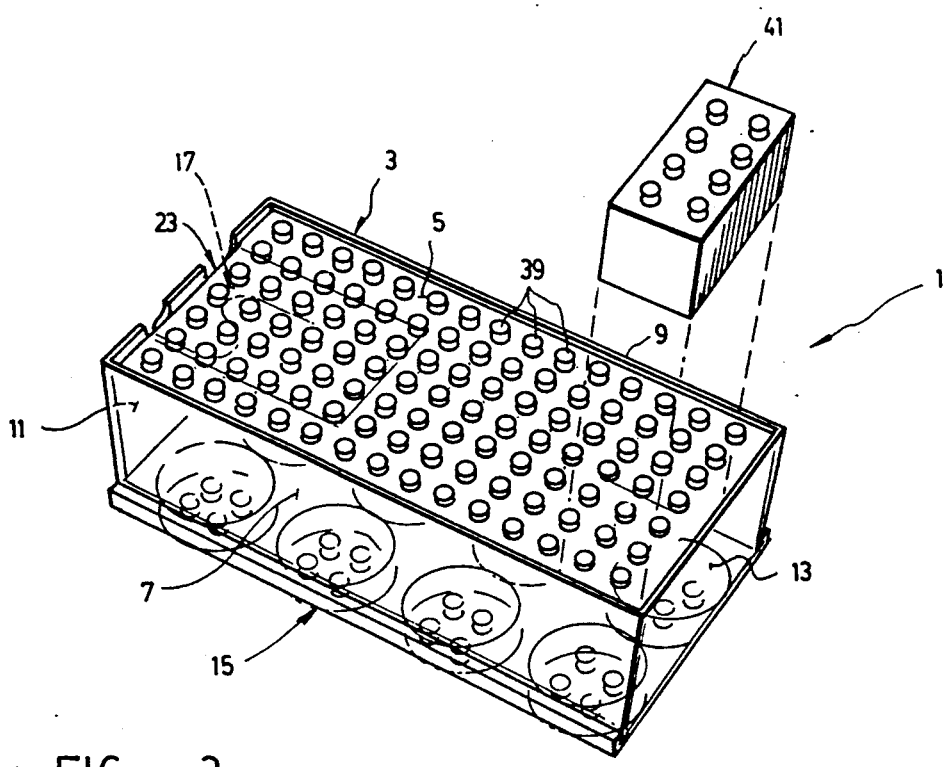
FIG. 2 is a bottom perspective view of the display packaging shown in FIG. 1, showing small coupling studs on its bottom wall for use to connect small construction toy blocks.

The display packaging 1 as shown in the accompanying drawings is intended to be used to sell construction toy blocks. To make the product more enjoyable for the children, the cover 15 and bottom wall 5 have their external surfaces provided with coupling studs on which construction toy blocks may be connected. The bottom wall may have small coupling studs 39 for receiving small construction toy blocks like the one numbered 41 in FIG. 2. The cover 15 may have large coupling studs 43 from which may project smaller coupling studs 45 similar to those numbered 39, for receiving larger construction toy blocks like the one numbered 47 in FIG. 1. As a result, the packaging 1 may be part of the construction assembly, in addition to being useful as a base member to hang onto a wall, a construction made on it with the toy blocks it originally contained.

What is claimed is:

1. A display packaging comprising in combination:

a box-shaped container made of a rigid material, said container having an opening to give access thereto and at least two flat walls perpendicular to each other;

a cover detachably fixable to said container to close said opening;

a flat hook slidably mounted inside said container onto one of said two flat walls near the other one of said two flat walls;

guiding means integral to said one flat wall for holding said hook flat onto said one flat wall while allowing said hook to be slid in a direction perpendicular to said other flat wall between a retracted position where said hook is located within said container and an extended position where said hook extends outwardly of said container through a slot provided for this purpose in said other flat wall, and retaining means to prevent said hook from sliding out of said guiding means in both of said retracted and extended positions, said retaining means being strong enough to allow said display packaging and its content to be hung by means of said hook whenever desired.

2. The display packaging of claim 1, wherein said hook has a hook-shaped front end and a rear end and wherein said retaining means includes at least one locking tab that integrally projects from said rear end and is sized and positioned to abutt against another locking tab or against said other wall provided with the slot in order to prevent the hook from sliding out of the container through said slot when said hook is in extended position and its hook-shaped front end projects out of the container through said slot.

3. The display packaging of claim 2, wherein said guiding means comprises a pair of rails facing each other and defining together with said one flat wall a trough in alignment with said slot.

4. The display packaging of claim 3, wherein said trough is closed at one end thereof opposite said slot, thereby making it useful as part of said retaining means to prevent said hook from sliding out of said guiding means in retracted position.

5. The display packaging of claim 4, wherein said box-shaped container is parallelepipedic in shape and includes a bottom wall, two long side walls and two small side walls and wherein said guiding means is integral to said bottom wall and located adjacent the middle of one of said small side walls thus acts as said other side wall with said slot.

6. The display packaging of claim 5, wherein the cover is flat and slidably mounted in a plane extending parallel to said bottom wall on top of the side walls of said container.

7. The display packaging of claim 5, for use to package connectable construction toy blocks, wherein said cover and bottom walls have external surfaces provided with coupling means on which said construction toy blocks may be connected.

8. The display packaging of claim 7, wherein said coupling means consists of small, cylindrical studs.

* * * * *